US011510444B1

(12) United States Patent
Weiser

(10) Patent No.: US 11,510,444 B1
(45) Date of Patent: Nov. 29, 2022

(54) ANTI-FOG STRIP FOR REMOVABLE FACE MASKS

(71) Applicant: Scott Weiser, New Port Richy, FL (US)

(72) Inventor: Scott Weiser, New Port Richy, FL (US)

( * ) Notice: Subject to any disclaimer, the term of this patent is extended or adjusted under 35 U.S.C. 154(b) by 0 days.

(21) Appl. No.: 17/408,188

(22) Filed: Aug. 20, 2021

(51) Int. Cl.
*A41D 13/11* (2006.01)

(52) U.S. Cl.
CPC ..... *A41D 13/11* (2013.01)

(58) Field of Classification Search
CPC .... A41D 13/05; A41D 13/11; A41D 13/1107; A41D 13/113; A41D 13/1146; A41D 13/1161; A41D 13/1169; A41D 13/1176; A41D 13/1184; A41D 13/1192; A41D 13/1115; A62B 7/00; A62B 7/10; A62B 18/08; A62B 9/06; A42B 3/24; A61F 2013/00553; A61F 2013/00561; A61F 2013/008; A61F 2013/00804; A61F 2013/00817; A61F 2013/00812; A61F 2013/00838; A61F 13/0253; A61F 13/0256; A61F 13/023; B01D 39/1623
See application file for complete search history.

(56) References Cited

U.S. PATENT DOCUMENTS 3,974,829 A 8/1976 Tate, Jr.
4,323,063 A 4/1982 Fisichella
4,367,732 A 1/1983 Poulsen et al.
4,657,010 A 4/1987 Wright
4,699,134 A * 10/1987 Samuelsen ..... A61F 13/0253 602/56
4,945,574 A 8/1990 Dagher
5,797,146 A 8/1998 Matich
5,803,075 A * 9/1998 Yavitz ..... A41D 13/1115 128/206.28
6,354,296 B1 3/2002 Baumann et al.
6,990,981 B2 1/2006 DuBois et al.
7,774,858 B2 8/2010 Kayerod
(Continued)

FOREIGN PATENT DOCUMENTS

EP 3669685 A1 6/2020
WO 2009126474 A2 10/2009
WO WO-2016025266 A1 * 2/2016 ..... A41D 13/1169

*Primary Examiner* — Erin Deery
*Assistant Examiner* — Gina McCarthy
(74) *Attorney, Agent, or Firm* — Mark C. Johnson; Johnson Dalal

(57) ABSTRACT

An anti-fog apparatus utilized with a facial mask or covering operably configured to inhibit the escape of exhaled vapor from the upper edge of facial coverings so as to prevent the accumulation of fog or condensation on a user's eyeglasses when wearing a face mask, the anti-fog strip comprising or used in conjunction with a cloth-based body and having an inner strip layer of a flexible material, with an outer surface adhesively coupled to the inner body surface, and with an inner surface opposing the outer surface of the inner strip layer; and an outer strip layer of a flexible polymeric foam material, with an inner surface adhesively coupled to the inner surface of the inner strip layer, and with an outer surface opposing the inner surface of the inner strip layer, wherein the outer strip layer is operably configured to elastically deform and contour to a user's nasal bridge.

14 Claims, 11 Drawing Sheets

(56) References Cited

U.S. PATENT DOCUMENTS

| | | | | |
|---|---|---|---|---|
| 7,802,572 | B2 | 9/2010 | Hahne | |
| 8,458,812 | B2 | 6/2013 | Kayerod | |
| D799,122 | S | 10/2017 | Kang | |
| 2002/0124844 | A1* | 9/2002 | Chiang | A62B 9/06 128/200.24 |
| 2004/0000313 | A1* | 1/2004 | Gaynor | B01D 39/1623 128/205.27 |
| 2010/0267302 | A1* | 10/2010 | Kantner | A61F 13/0256 427/208.4 |
| 2014/0005607 | A1* | 1/2014 | Elsamahy | A61F 13/023 604/180 |
| 2017/0027251 | A1 | 2/2017 | Kang | |
| 2019/0021993 | A1 | 1/2019 | Green | |
| 2020/0121004 | A1* | 4/2020 | Loughran | A62B 18/08 |
| 2020/0246645 | A1 | 8/2020 | O'Leary et al. | |
| 2020/0404992 | A1* | 12/2020 | Friedman | A41D 13/1161 |

* cited by examiner

ANTI-FOG STRIP FOR REMOVABLE FACE MASKS

FIELD OF THE INVENTION

The present invention relates generally to face masks and, more particularly, relates to an anti-fog apparatus utilized with a face mask.

BACKGROUND OF THE INVENTION

In light of the resurgence of viral and bacterial pandemics across the globe, the use and popularity of personal protective equipment, also commonly referred to as "PPE", has grown in recent months. Face masks are one sub-category or type of PPE that has become both widely used and at times even recommended or required by government and regulatory bodies. There are a variety of existing types of face masks known in the industry including, by way of example, cloth masks, disposable surgical masks, neck gaiters and balaclavas, N95 masks, KN95 masks, and bandanas. The current design of cloth and surgical face masks, however, tends to inconvenience users who wear eyeglasses, e.g., reading glasses, safety glasses, etc., insofar as a user's breathing during use induces the accumulation of fog and condensation on the user's eyeglasses thereby obstructing the user's vision and line of sight. This phenomenon occurs when warm air vapor exhaled by a user escapes from the upper edges of the user's face mask, interacts with the colder air outside the face mask, and forms a layer of condensation on the user's eyeglasses. Continuous or repeated fogging of a facial covering user's eyeglasses can pose a significant safety concern and can seriously interfere with the daily activities of a user, e.g., truck drivers who wear prescription glasses are unable to maintain a clear line of vision of the road, children who wear reading glasses are unable to read their assignments, etc.

Obstructing or preventing the vapor from escaping through the upper edge of a user' face mask can prevent the same from condensing on a user's eyeglasses. Existing prior art, though designed to inhibit the passage of vapor between the mask and the wearer, achieves this through different mechanisms which are characterized by several limitations. For one, the structural composition of the existing prior art is such that an adhesive strip or portion is directly and selectively affixed to the wearer's skin which is both impractical for repeated wear, particularly because face masks are often repeatedly removed and reattached within short periods of time, and which is likely to cause epidermal irritations, allergic reactions, or discomfort for the user. See, e.g., Baumann et al. (3M Innovative Properties Company), U.S. Pat. No. 6,354,296 B1 (Mar. 12, 2002); Helle Kayerød (Kreaps APS), U.S. Pat. No. 7,774,858 B2 (Aug. 17, 2010); O'Leary et al., U.S. Patent Publication No. 2020/0246645 A1 (Aug. 6, 2020). Additional prior art provides for a barrier (in the form of, by way of example, a soft foam or a resinous strip-shaped nose clip member) interposed between the upper edge of the face mask and the user's face that does not form a flush configuration with the user's face or that otherwise fails to adequately inhibit the passage of vapor between the mask and the wearer. See, e.g., Ugai et al. (3M Innovative Properties Company), International Publication No. WO2009/126,474 A2 (Oct. 15, 2009); George W. Tate, Jr. (Giles C. Clegg, Jr. and John R. Lynn), U.S. Pat. No. 3,974,829 A (Aug. 17, 1976). Accordingly, vapor is still likely to escape from the upper edge of the mask and cause the accumulation of fog or condensation on a user's eyeglasses and obstructing the user's sight. With respect to existing prior art comprising a resinous strip-shaped nose clip member, such members generally lack any type of protective covering on each opposing end, thereby increasing the risk for inadvertent tears resulting in the exposure of the member from within the face mask. In turn, this exposure can cause harm or injury to users, particularly minors or children, given that the opposing ends of the nose-clip member are typically sharp or rough. Further, the existing prior art lacks any adhering structure or member disposed on the lower edge of the face mask to securely retain the bottom portion of the face mask onto the wearer's face and to better enclose the wearer's face so as to substantially obstruct or prevent the entry of foreign particles, bacteria, and viruses therein.

Therefore, a need exists to overcome the problems with the prior art as discussed above.

SUMMARY OF THE INVENTION

The invention provides an anti-fog strip for removable face masks that overcomes the hereinafore-mentioned disadvantages of the heretofore-known devices and methods of this general type and that provides a safer and more comfortable alternative to traditional face masks that prevents fogging of user's eyeglasses during use. The present invention comprises a smooth, comfortable, hypoallergenic, flexible, stretchable, breathable, and waterproof scaling material designed to come into direct physical contact with a wearer's epidermis to securely retain the face mask onto the wearer's face and form a barrier that is substantially flush with the wearer's epidermis to prevent exhaled vapor from fogging a user's eyeglasses without irritating the user's skin. The anti-fog strip further comprises a conformable element tipped with a rubber constituent, or another substantially comparable constituent, so as to qualify for child safe construction and a high tack double-sided material with a peel strip facing outward, making it simple to selectively and removably apply the anti-fog strip to any facial mask or covering. Given the recent proliferation of government and business mandates requiring the use of facial coverings, the present invention provides a simple and easy solution to the problem plaguing countless facial mask wearers, namely, fogging of wearers' eyeglasses thereby obstructing their vision and interfering with their daily activities.

With the foregoing and other objects in view, there is provided, in accordance with the invention, an anti-fog strip for removable face masks comprising a cloth-based body having a first ear loop coupled thereto, a second ear loop coupled thereto, an upper body edge, a lower body edge opposing the upper body edge, an outer body surface, an inner body surface opposing the outer body surface, and an anti-fog strip layup disposed proximal to the upper body edge and having an inner strip layer of a flexible material, with an outer surface adhesively coupled to the inner body surface, and with an inner surface opposing the outer surface of the inner strip layer; and an outer strip layer of a flexible polymeric foam material, with an inner surface adhesively coupled to the inner surface of the inner strip layer, and with an outer surface opposing the inner surface of the inner strip layer, wherein the outer strip layer is operably configured to elastically deform and contour to a user's nasal bridge.

In accordance with a further feature of the present invention, the anti-fog strip layup further comprises a retaining wire member of a deformably rigid metallic material encapsulated and adhesively retained by the inner and outer strip layers.

In accordance with another feature, the retaining wire member also includes a two opposing ends and a wire length separating the two opposing ends, the wire length sized to be at least 75% a layup length separating two opposing ends of the anti-fog strip layup.

In accordance with a further feature of the present invention, the retaining wire member further comprises two opposing ends and a wire length separating the two opposing ends, wherein each of the two opposing ends of the retaining wire member are respectively surrounded by rubber coverings.

In accordance with a further feature of the present invention, the outer strip layer further comprises two opposing ends and a outer strip length separating the two opposing ends of the outer strip layer; a first removable section defining one of the two opposing ends and selectively removably coupled to the inner strip layer and a stationary section, the first removable section and the stationary section flanking a perforated channel and the first removable section operably configured to be removed and expose the inner surface of the inner strip layer; and a second removable section defining another of the two opposing ends and selectively removably coupled to the inner strip layer and the stationary section, the second removable section and the stationary section flanking a perforated channel and the second removable section operably configured to be removed and expose the inner surface of the inner strip layer.

In accordance with a further feature of the present invention, the anti-fog strip layup also comprises a retaining wire member of a deformably rigid metallic material encapsulated, adhesively retained by the inner strip layer and the stationary section, having two opposing ends, and having a wire length separating the two opposing ends.

In accordance with another feature, an embodiment of the present invention also includes a wire length that does not extend to either the first removable section or the second removable section.

In accordance with yet another feature, the outer strip layer is of an elastic flexible polymeric foam material and the inner strip layer is of an inelastic polymeric material.

In accordance with a further feature, an embodiment of the present invention also includes a lower strip layup disposed proximal to the lower body edge of the cloth-based body and having an inner strip layer of a flexible material, with an outer surface adhesively coupled to the inner body surface, and with an inner surface opposing the outer surface of the inner strip layer; and an outer strip layer of a flexible polymeric foam material, with an inner surface adhesively coupled to the inner surface of the inner strip layer, and with an outer surface opposing the inner surface of the inner strip layer, wherein the outer strip layer is operably configured to elastically deform and contour a user's nasal bridge.

In accordance with another feature of the present invention, the outer strip layer of the lower strip layup disposed proximal to the lower body edge of the cloth-based body further comprises two opposing ends and a outer strip length separating the two opposing ends of the outer strip layer; a first removable section defining one of the two opposing ends and selectively removably coupled to the inner strip layer and a stationary section, the first removable section and the stationary section flanking a perforated channel and the first removable section operably configured to be removed and expose the inner surface of the inner strip layer; and a second removable section defining another of the two opposing ends and selectively removably coupled to the inner strip layer and the stationary section, the second removable section and the stationary section flanking a perforated channel and the second removable section operably configured to be removed and expose the inner surface of the inner strip layer.

In accordance with yet another feature of one embodiment of the present invention, the inner strip layer is of an inelastic polymeric material.

In accordance with a further feature, the cloth-based body further includes a left body edge with the first ear loop extending outwardly therefrom and interposing the upper and lower body edges; a right body edge with the second ear loop extending outwardly therefrom and interposing the upper and lower body edges; an upper edge length defined by the upper body edge and separating the left and right body edges, wherein a layup length separating two opposing ends of the anti-fog strip layup spans at least 75% of the upper edge length; and an lower edge length defined by the lower body edge and separating the left and right body edges.

In accordance with one embodiment of the present invention, the layup length separating the two opposing ends of the anti-fog strip layup is between approximately 5 inches and 5.5 inches in length.

In accordance with the present invention, an improvement used in combination with a cloth-based body having a first ear loop coupled thereto, a second ear loop coupled thereto, an upper body edge, a lower body edge opposing the upper body edge, an outer body surface, and an inner body surface opposing the outer body surface, wherein the improvement comprises an anti-fog strip layup disposed proximal to the upper body edge and having an inner strip layer of a flexible material, with an outer surface adhesively coupled to the inner body surface, and with an inner surface opposing the outer surface of the inner strip layer; and an outer strip layer of a flexible polymeric foam material, with an inner surface adhesively coupled to the inner surface of the inner strip layer, and with an outer surface opposing the inner surface of the inner strip layer, wherein the outer strip layer is operably configured to elastically deform and contour to a user's nasal bridge.

Although the invention is illustrated and described herein as embodied in an anti-fog strip 100 for removable face masks, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). All dimensions and measurements provided herein are not intended to be limiting; but rather, to provide exemplary dimensions and measurements. In many instances these terms may include numbers that are rounded to the nearest significant figure. In this document, the term "longitudinal" should be understood to mean in a direction corresponding to an elongated direction of the cloth-based body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
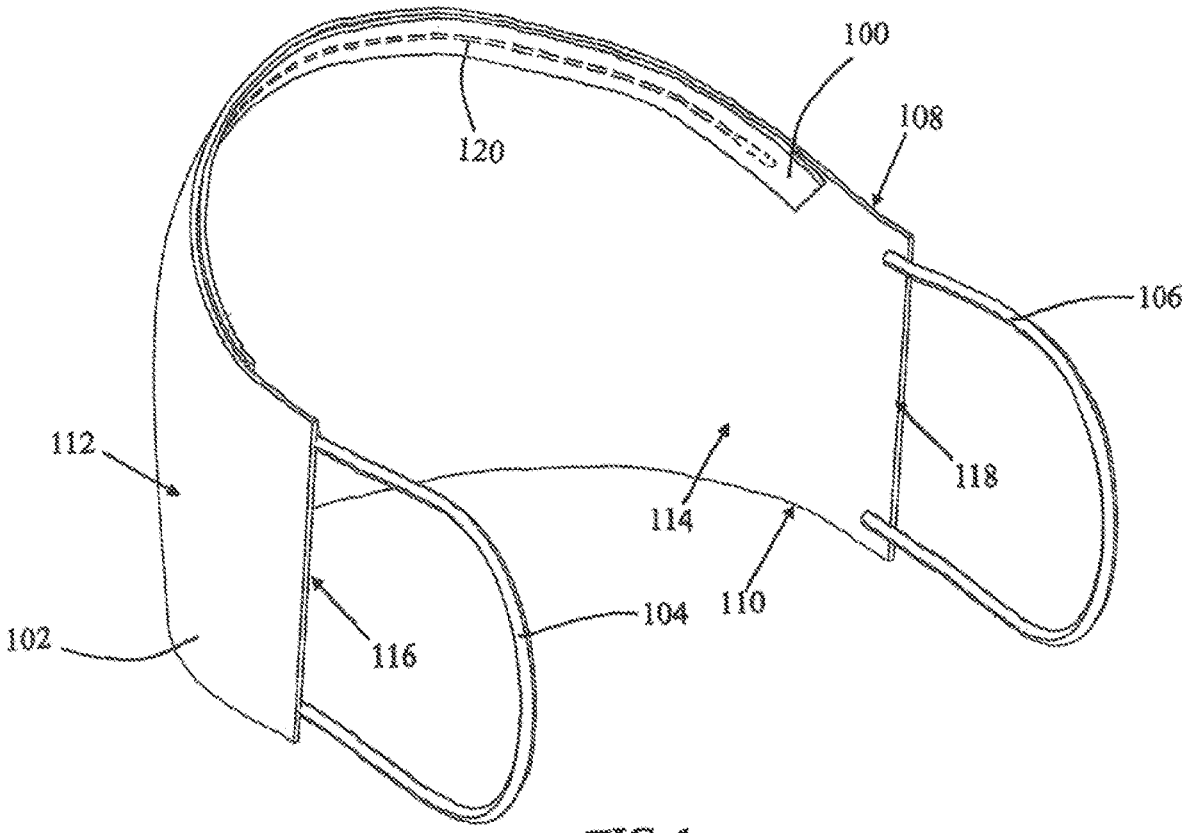
FIG. 1 is a perspective rear view of an anti-fog strip for removable face masks and a cloth-based body, in accordance with an exemplary embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and comfortable anti-fog strip for removable face masks which functions to better insulate a user's face from coming into contact with foreign pathogens, particles, viruses, and bacteria while preserving the breathability and comfort of wearing a facial mask or covering. Embodiments of the invention provide for an anti-fog strip operably configured to obstruct a user's exhaled vapor from escaping through the upper edge of the facial mask or covering where said vapor typically forms a layer of condensation on a user's eyeglasses, resulting in a partially or fully obstructed view. In addition, embodiments of the invention provide a conformable element tipped with a rubber constituent, or another substantially comparable constituent, so as to qualify for childsafe construction and a high tack double-sided material with a peel strip facing outward, making it simple to selectively and removably apply the anti-fog strip to any facial mask or covering.

Figure 2:
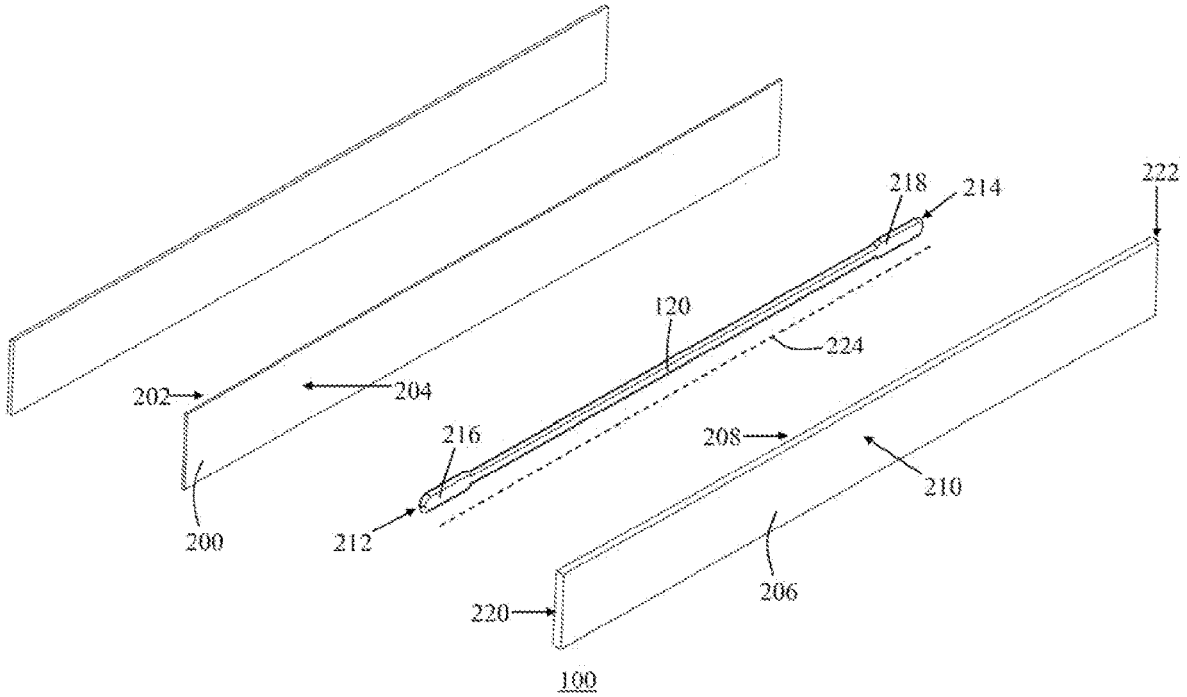
FIG. 2 is a perspective side view of an exemplary inner strip layer, outer strip layer, and retaining wire member, in accordance with the present invention.

Referring now to FIG. 1, one embodiment of the present invention is shown in a perspective rear view. FIG. 1 shows several advantageous features of the present invention, but, as will be described below, the invention can be provided in several shapes, sizes, combinations of features and components, and varying numbers and functions of the components. The first example of an anti-fog strip 100 for removable face masks, as shown in FIGS. 1-2, includes a cloth-based body 102 having a first ear loop 104 coupled thereto, a second ear loop 106 coupled thereto, an upper body edge 108, a lower body edge 110 opposing the upper body edge 108, an outer body surface 112, an inner body surface 114 opposing the outer body surface 112, and an anti-fog strip layup 100 disposed proximal to (wherein "proximal to" is defined as at or near, within 5% to 10% of the overall distance, to the upper body edge 108) the upper body edge 108. The cloth-based body 102 may generally be that of a variety of existing types of facial coverings known in the industry including, by way of example, cloth masks, disposable surgical masks, neck gaiters and balaclavas, N95 masks, KN95 masks, and bandanas. While the figures depict the anti-fog strip 100 on a disposable surgical mask, this should not be construed as limiting as the anti-fog strip 100 may be used on or in conjunction with a variety of other facial coverings. When in use, the upper body edge 108 of the cloth-based body 102 sits right below a user's eyes and on the bridge of a user's nose. Depending on the specific type of facial mask used, the lower body edge 110 may sit on or right below a user's chin. The outer body surface 112 faces outwardly away from a user when the anti-fog strip 100 is being worn whereas the inner body surface 114 faces inwardly toward a user when the anti-fog strip 100 is being worn. In one embodiment, the anti-fog strip 100 is selectively removable from the cloth-based body 102 such that the anti-fog strip 100 may be selectively removably adhered or affixed to multiple facial masks or coverings. This embodiment is particularly beneficial as it facilitates a wider variety of use and application of the anti-fog strip 100 onto various different shapes, forms, and types of facial coverings. In another embodiment, the anti-fog strip 100 is permanently affixed or coupled to, or embedded in, the cloth-based body 102 during the manufacturing process such that users are unable to selectively removably detach the anti-fog strip 100 from the cloth-based body 102. This embodiment is beneficial insofar as it provides for one composite assembly wherein the anti-fog strip 100 is more securely and permanently coupled to the cloth-based body 102.

Figure 10:
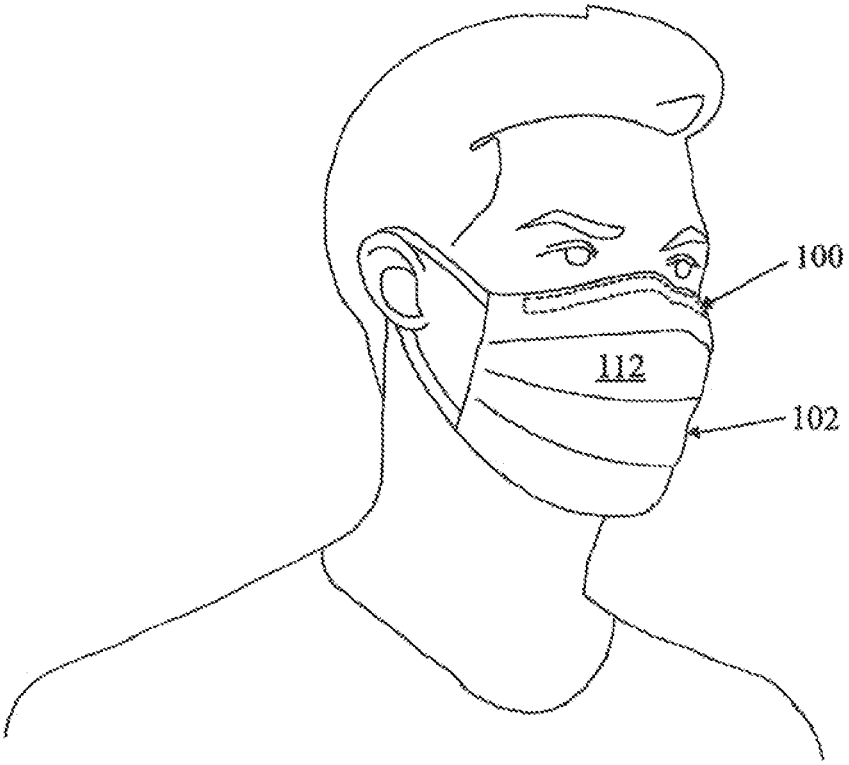
FIG. 10 is a perspective front view of another exemplary embodiment of an anti-fog strip layup being worn by a user, in accordance with the present invention.
Figure 11:
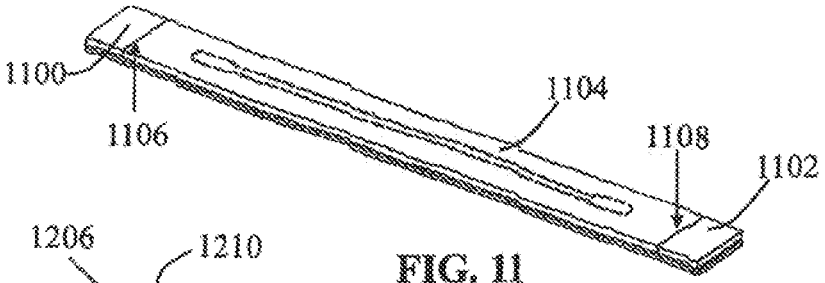
FIG. 11 is a perspective rear view of yet another exemplary embodiment of an anti-fog strip for removable face masks, in accordance with the present invention.
Figure 12:
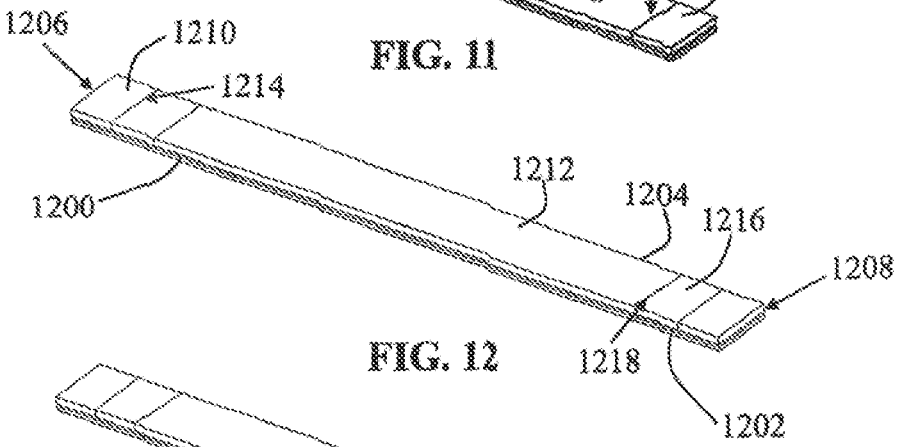
FIG. 12 is a perspective front view of an exemplary embodiment of a lower strip layup, in accordance with the present invention.
Figure 13:
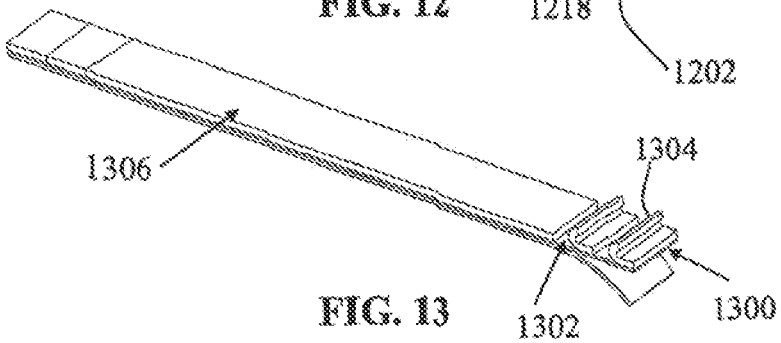
FIG. 13 is a perspective front view of a partially peeled lower strip layup, in accordance with the present invention.
Figure 14:
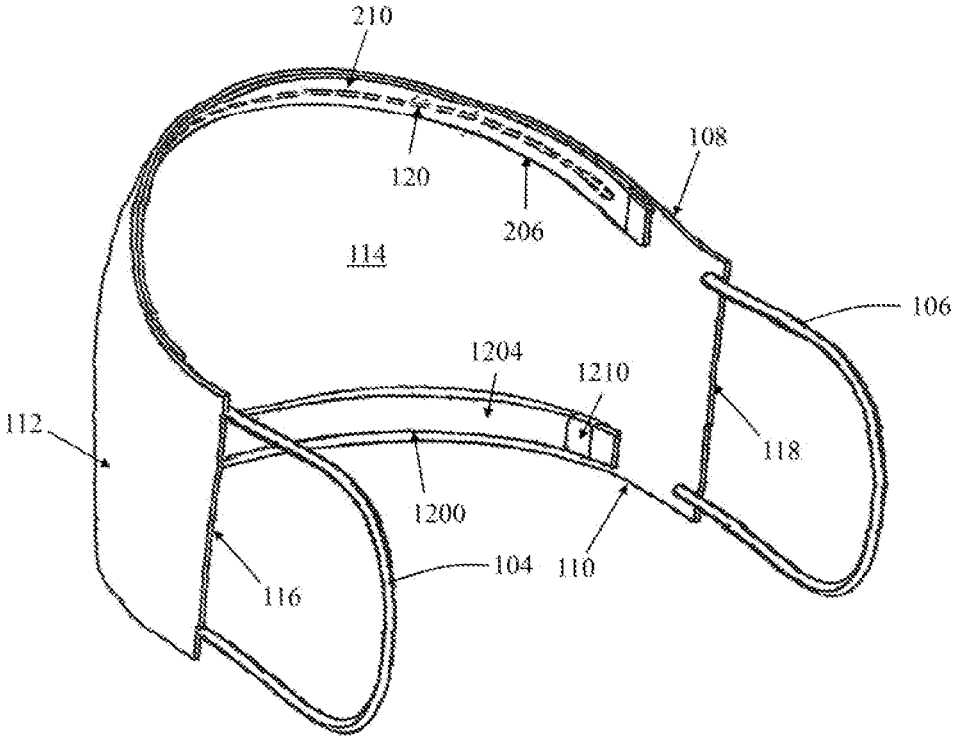
FIG. 14 is a perspective rear view of an anti-fog strip for removable face masks and a cloth-based body, in accordance with one embodiment of the present invention.
Figure 15:
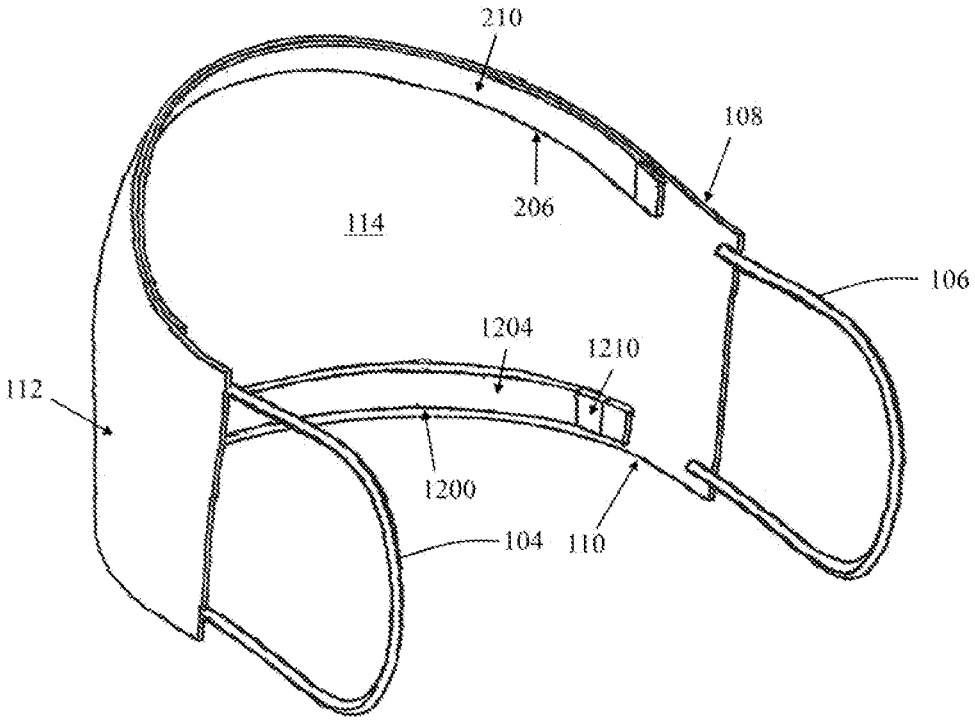
FIG. 15 is a perspective rear view of an anti-fog strip for removable face masks and a cloth-based body, in accordance with another embodiment of the present invention.

It should be understood that terms such as, "front," "rear," "side," top," "bottom," and the like are indicated from the reference point of a viewer viewing the anti-fog strip 100 from the outer body surface 112 when the anti-fog strip 100 is being worn by a user (see FIG. 10).

The anti-fog strip layup 100 comprises an inner strip layer 200 (as best depicted in FIG. 2) of a flexible material, with an outer surface 202 adhesively coupled to the inner body surface 114, and with an inner surface 204 opposing the outer surface 202 of the inner strip layer 200. In an exemplary embodiment, the inner strip layer 200 is of a high-tack double-sided tape material composition characterized by a carrier substrate material such as film, foam, paper, cloth or a foil carrier, with an acrylic, acetate, rubber, or silicone adhesive coated on both sides of the carrier substrate material in any combination. This type of high-tack double-sided adhesive is used by a vast array of industries for applications such as bonding, holding, mounting, splicing, and packaging. The adhesive preferably withstands temperature ranges from −40° F.-200° F. for extreme hold during indoor/outdoor use and is weather resistant for year-long durability. Its flexibility enables the anti-fog strip layup 100 to be manipulated when being applied onto a facial mask or covering so as to facilitate use of the anti-fog strip layup 100 on a variety of different forms, shapes, and types of facial coverings. The strong adhesive bond prevents the anti-fog strip layup 100 from inadvertently detaching or decoupling from the facial mask or covering during use and when at rest.

The anti-fog strip layup 100 further comprises an outer strip layer 206 of a flexible polymeric foam material, with an inner surface 208 adhesively coupled to the inner surface 204 of the inner strip layer 200, and with an outer surface 210 opposing the inner surface 204 of the inner strip layer 200, wherein the outer strip layer 206 is operably configured to elastically deform and contour to a user's nasal bridge. In an exemplary embodiment, the outer strip layer 206 is of a high-tack double-sided tape material composition characterized by a carrier substrate material such as film, foam, paper, cloth or a foil carrier, with an acrylic, acetate, rubber, or silicone adhesive coated on both sides of the carrier substrate material in any combination. This type of high-tack double-sided adhesive, such as that sold by 3M™ as Nexcare™ absolute waterproof tape, is used by a vast array of industries for applications such as bonding, holding, mounting, splicing, and packaging. The adhesive preferably withstands temperature ranges from −40° F.-200° F. for extreme hold during indoor/outdoor use and is weather resistant for year-long durability. The flexible polymeric foam material may be an open-cell or closed-cell foam and/or may be an acrylic foam. Open cell foam is a rubber-like product made by incorporating an inflating agent, such as sodium bicarbonate, into the rubber compound; this agent gives off a gas, which expands the rubber during vulcanization. Foam is usually classified as "open cell" when more than half of its cells are open. Common open cell materials include reticulated foam, polyurethane foam, and open cell rubber. Some open cell foam is unique in that it operates more like a spring, easily returning to its original state after compression thanks to the unrestricted air movement and chemical makeup. Soft and breathable, open cell foam is generally more flexible and can more easily conform to sealing applications than closed cell foam. Open cell foam can also be manufactured at both high and low densities. It is less durable than closed cell options, however. Reticulated foam is usually classified by PPI (pores per inch). 10 PPI foam would have large cell structures and allow the most flow, while 80 PPI foam would have very small cells and be more restrictive. Closed cell foam is defined as a cell totally enclosed by its walls and hence not interconnecting with other cells. Closed cell foam is usually made by subjecting a rubber compound to a gas, such as nitrogen, under high pressure. This type of foam may also be made by incorporating gas-forming materials into the compound. Closed cell foam offers a wide variety of material and density options. EPDM, neoprene, EPDM/CR/SBR, and PVC/NBR are a few common types of closed cell foams, which can range in densities from 6 lb/ft3 (soft) to 19 lb/ft3 (hard). This type of material is ideal for sealing as it effectively reduces liquid and gas flow. Closed cell foam is also ideal for industries in which liquid resistance is critical. In exemplary embodiments, the inner strip layer 200 and the outer strip layer 206 are approximately 5.75 inches long and 0.375 inches wide.

In one embodiment, the outer surface 210 may include a pressure sensitive adhesive (PSA), possibly also with a liner. Pressure sensitive adhesive tape is a strip of cloth, paper, metal, or plastic that has permanently tacky adhesive on one or both sides of it. The special feature of pressure sensitive adhesives is that they do not solidify to form a solid material, but remain viscous. As a result, they remain permanently tacky and have the ability to wet surfaces on contact. Bonds are made by bringing the adhesive film in contact with the substrate and applying pressure. If inadequate pressure is applied or the processing temperature is too low, bonding faults such as bubbles or detachment can occur. Since these adhesives are not true solids, the strength of pressure sensitive adhesives decreases when the temperature is increased. Pressure sensitive adhesives also exhibit a tendency to undergo creep when subjected to loads. They are typically formulated from natural rubber, certain synthetic rubbers, and polyacrylates. Pressure sensitive adhesives can be supplied dissolved in organic solvents, as an aqueous dispersion, as a hot melt, or coated on release liner as tape. Liquid applied (solvent or water based, hot melt) pressure sensitive adhesives can be applied in bead or ribbon, sprayed, or roll coated. After coating (and drying of solvent or water based systems), parts can be bonded or the adhesive covered with release liner for bonding later. The adhesive can be coated in a pattern to provide bonded and unbonded areas, e.g. assembly of membrane switches, filter frames. Characteristics of pressure sensitive adhesives include adhesive (referring to the strength of the adhesive or the sticky material to the substrate, or the surface the tape sticks to), cohesion (referring to the strength of the adhesive or the strength of the stickiness), and tack (referring to how long the adhesive takes to stick to a given substrate or surface, i.e., an extremely tacky tape would stick immediately with little pressure). Because of their characteristics and thin and lightweight qualities, PSAs are ideal for use on or with the outer surface 210. The outer surface 210 of the outer strip layer 206 is operably configured to elastically deform and contour to a user's nasal bridge, inhibiting the escape of exhaled vapor from the upper body edge 108 of the cloth-based body 102 and preventing the accumulation of fog or condensation on a user's eyeglasses. In this way, the anti-fog strip layup 100 provides greater comfort and convenience to users wearing a facial mask or covering simultaneously with eyeglasses. In turn, this beneficial feature of the anti-fog strip layup 100 enhances users' safety and well-being during use.

Referring now to FIGS. 1-4, in accordance with a further feature of one embodiment of the present invention, the anti-fog strip layup 100 further comprises a retaining wire member 120 of a deformably rigid metallic material encapsulated and adhesively retained by the inner and outer strip layers 200, 206. The retaining wire member 120 is operably configured to be variably sized to substantially contour, and then retain its contoured shape over a user's nasal bridge. Further, the retaining wire member 120 is deformably rigid in that it allows a user to deform its shape and/or size, and yet retain the structural rigidity of that material when placed in said modified shape and/or size. Said differently, the material is rigid, yet has shape memory properties, e.g., a nickel-titanium alloy. The retaining wire member 120 is preferably substantially planar to comfortably and snugly rest on or over a user's nasal bridge without digging into a user's skin. The substantially planar property of the retaining wire member 120 also provides for a compact assembly with respect to the anti-fog strip layup 100 and the positioning of the retaining wire member 120 between the inner and outer strip layers 200, 206. In one embodiment, a plurality of pinhole vents are proximally disposed around the end of the retaining wire member 120 creating air pockets for air to continually vent through, providing for greater breathability of the facial mask or covering.

In accordance with a further feature, the retaining wire member 120 further comprises a two opposing ends 212, 214 and a wire length 224 separating the two opposing ends 212, 214, the wire length 224 sized to be at least 75% a layup length 304 separating a two opposing ends 300, 302 of the anti-fog strip layup 100. The layup length 304 ranges between approximately 5 inches and 6 inches in preferred embodiments and has an exemplary length of 5.75 inches. By spanning across at least 75% of the layup length 304, the wire length 224 is of a length sufficient to span horizontally across a user's nasal bridge and eyes to fully and completely seal the free space between a user's face and the anti-fog strip layup 100, preventing the escape of vapor from the upper body edge 108 of the cloth-based body 102. The retaining wire member 120 further beneficially reinforces the seal between a user's face and the anti-fog strip layup 100. In an exemplary embodiment, the wire length 224 is approximately 5 inches.

As depicted in FIG. 2, the retaining wire member 120 may further comprise two opposing ends 212, 214 and the wire length 224 separating the two opposing ends 212, 214, wherein each of the two opposing ends 212, 214 of the retaining wire member 120 are respectively surrounded by rubber coverings 216, 218. The two opposing ends 212, 214 are each dipped and encapsulated in a flexible, resilient, polymeric (e.g., rubber) material such as, by way of example and without limitation, the Plasti Dip® Multi-Purpose Rubber Coating, to cover the sharp or rough two opposing ends 212, 214 of the retaining wire member 120. This feature beneficially safeguards against accidental cuts, nicks, or injuries arising from direct physical contact with the two opposing ends 212, 214, particularly with respect to anti-fog strips 100 incorporated in, or used in conjunction with, children's facial coverings. The safety rubber coverings 216, 218 cover approximately 0.25 inches of each of the two opposing ends 212, 214.

In one preferred embodiment, the outer strip layer 206 also comprises two opposing ends 220, 222 and a outer strip length 226 separating the two opposing ends 220, 222 of the outer strip layer 206. In preferred embodiments, the outer strip length 226 ranges between approximately 5.5 inches and 6 inches. The outer strip layer 206 further comprises a first removable section 1100 defining one of the two opposing ends 220, 222 and selectively removably coupled to the inner strip layer 200 and a stationary section 1104, the first removable section 1100 and the stationary section 1104 flanking a perforated channel 1106 and the first removable section 1100 operably configured to be removed and expose the inner surface 204 of the inner strip layer 200; and a second removable section 1102 defining another of the two opposing ends 220, 222 and selectively removably coupled to the inner strip layer 200 and the stationary section 1104, the second removable section 1102 and the stationary section 1104 flanking a perforated channel 1108 and the second removable section 1102 operably configured to be removed and expose the inner surface 204 of the inner strip layer 200. The high-tack adhesive on the exposed inner surface 204 of the inner strip layer 200 is selectively removably couplable to a user's face for a reinforced bond between the anti-fog strip 100 and a user's face. In alternate embodiments, the outer strip layer 206 may comprise a plurality of first removable sections 1100*a-n*, wherein "n" refers to any number greater than one, and/or a plurality of second removable sections 1102*a-n* such that the more removable sections that are removed, the stronger the bond between the anti-fog strip 100 and a user's face. A stronger or more reinforced bond further inhibits the escape of vapor from the upper edge 108 of the cloth-based body 102 to substantially prevent the fogging of a user's eyeglasses when wearing a face mask. The first and second removable sections 1100, 1102 are approximately 0.1875 inches in length in a preferred embodiment. The perforated channels 1106, 1108 facilitate the fast, easy, and convenient detachment and removal of the first and second removable sections 1100, 1102 to expose the inner surface 204 of the inner strip layer 200. In one embodiment, the retaining wire member 120 is encapsulated and adhesively retained by the high-tack adhesive of the inner strip layer 200 and by the stationary section 1104.

In accordance with a further feature of the present invention, the wire length 224 of the retaining wire member 120 does not extend to either the first removable section 1100 or the second removable section 1102. This beneficial feature ensures that the retaining wire member 120 is fully encapsulated and retained by the inner strip layer 200 and by the stationary section 1104 and is not exposed when the first removable section 1100 and/or the second removable section 1102 is removed.

In one embodiment, the outer strip layer 206 is of an elastic flexible polymeric foam material and/or the inner strip layer 200 is of an inelastic polymeric material, e.g., a knit cloth polyethylene (PE). The flexibility of the outer strip layer 206 allows the anti-fog strip 100 to be snugly fit (preferably in a flush configuration) onto any user's nasal bridge so as to prevent exhaled vapor from escaping through the upper body edge 108 of the cloth-based body 102. The inelastic polymeric composition of the inner strip layer 200, on the other hand, facilitates a secure bond or adhesion between the anti-fog strip 100 and the facial covering, more specifically, the cloth-based body 102.

In an exemplary embodiment, the anti-fog strip layup 100 further comprises a lower strip layup 1200 disposed proximal to the lower body edge 110 of the cloth-based body 102 and having an inner strip layer 1202 of a flexible material, with an outer surface 1300 adhesively coupled to the inner body surface 114, and with an inner surface 1302 opposing the outer surface 1300 of the inner strip layer 1202; and an outer strip layer 1204 of a flexible polymeric foam material, with an inner surface 1304 adhesively coupled to the inner surface 1302 of the inner strip layer 1202, and with an outer surface 1306 opposing the inner surface 1302 of the inner strip layer 1202, wherein the outer strip layer 1204 is operably configured to elastically deform and contour a user's nasal bridge. The lower strip layup 1200 is best depicted in FIGS. 6-8 and FIGS. 12-15. Given the placement of the lower strip layup 1200 on or around a user's chin or neck area, as opposed to a user's nasal bridge, the need for a retaining wire member 120 within the lower strip layup 1200 is substantially diminished. Rather, the outer surface 1306 of the outer strip layer 1204 supplies the gripping capability required to seal the lower body edge 110 of the cloth-based body 102 against a user's skin, i.e., against their chin or neck area. As a means of providing a more secure fit between the lower body edge 110 of the cloth-based body 102 and a user's skin, however, the outer strip layer 1204 may further comprise two opposing ends 1206, 1208 and a outer strip length separating the two opposing ends 1206, 1208 of the outer strip layer 1204; a first removable section 1210 defining one of the two opposing ends 1206, 1208 and selectively removably coupled to the inner strip layer 1202 and a stationary section 1212, the first removable section 1210 and the stationary section 1212 flanking a perforated channel 1214 and the first removable section 1210 operably configured to be removed and expose the inner surface 1302 of the inner strip layer 1202; and a second removable section 1216 defining another of the two opposing ends 1206, 1208 and selectively removably coupled to the inner strip layer 1202 and the stationary section 1212, the second removable section 1216 and the stationary section 1212 flanking a perforated channel 1218 and the second removable section 1216 operably configured to be removed and expose the inner surface 1302 of the inner strip layer 1202. The high-tack adhesive on the exposed inner surface 1302 of the inner strip layer 1202 is selectively removably couplable to a user's face for a reinforced bond between the anti-fog strip 100 and a user's face. In alternate embodiments, the outer strip layer 1204 may comprise a plurality of first removable sections 1210*a-n*, wherein "n" refers to any number greater than one, and/or a plurality of second removable sections 1216*a-n* such that the more removable sections that are removed, the stronger the bond between the anti-fog strip 100 and a user's face. A stronger or more reinforced bond further inhibits the escape of vapor from the lower edge 110 of the cloth-based body 102 to substantially prevent the fogging of a user's eyeglasses when wearing a face mask. The first and second removable sections 1210, 1216 are approximately 0.1875 inches in length in a preferred embodiment. The perforated channels 1214, 1218 facilitate the fast, easy, and convenient detachment and removal of the first and second removable sections 1210, 1216 to expose the inner surface 1302 of the inner strip layer 1202.

Figure 3:
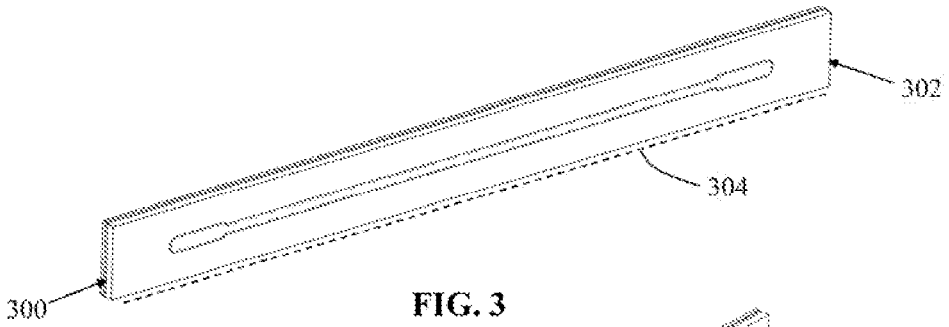
FIG. 3 is a perspective rear view of an anti-fog strip layup, in accordance with an exemplary embodiment of the present invention.
Figure 4:
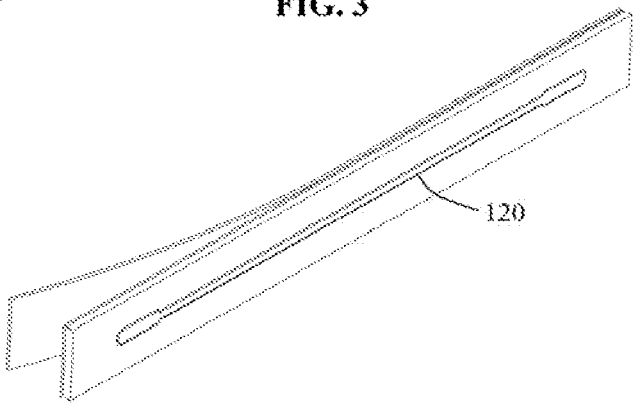
FIG. 4 is a perspective rear view of a partially peeled anti-fog strip layup, in accordance with an exemplary embodiment of the present invention.
Figure 5:
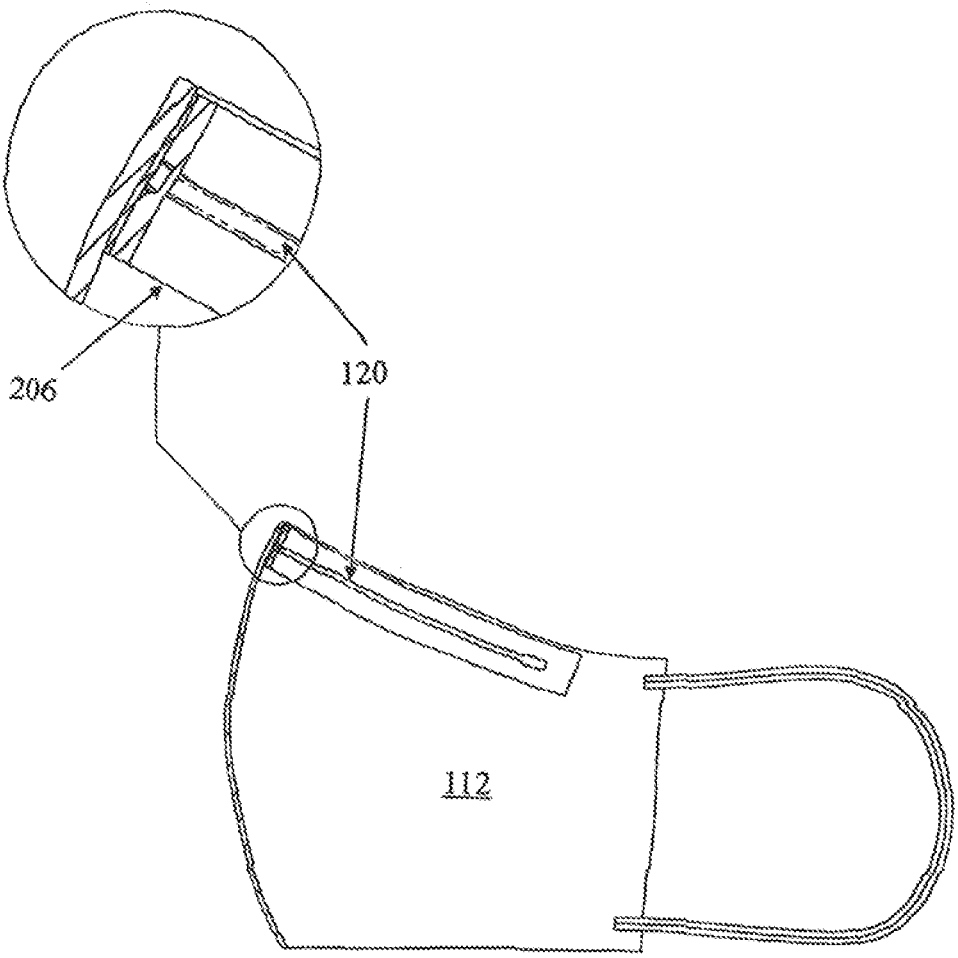
FIG. 5 is an elevational and partially zoomed in side view of an anti-fog strip for removable face masks and a cloth-based body, in accordance with one embodiment of the present invention.
Figure 6:
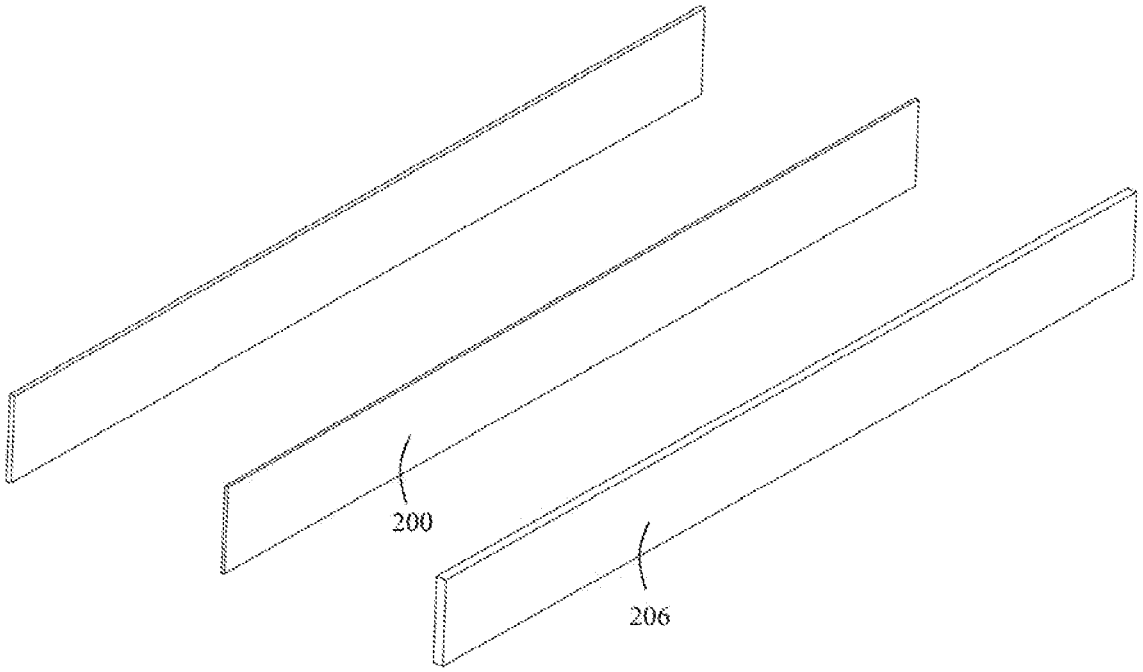
FIG. 6 is a perspective side view of an exploded lower strip layup, in accordance with an exemplary embodiment of the present invention.
Figure 7:
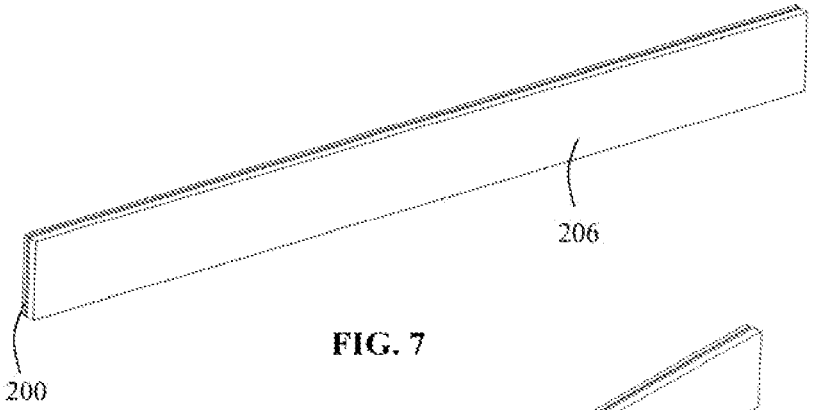
FIG. 7 is a perspective front view of an exemplary lower strip layup, in accordance with the present invention.
Figure 8:
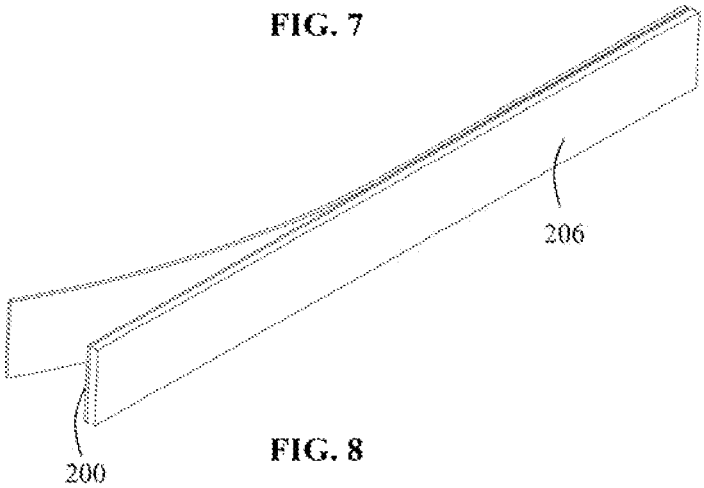
FIG. 8 is a perspective front view of an exemplary and partially peeled lower strip layup, in accordance with the present invention.
Figure 9:
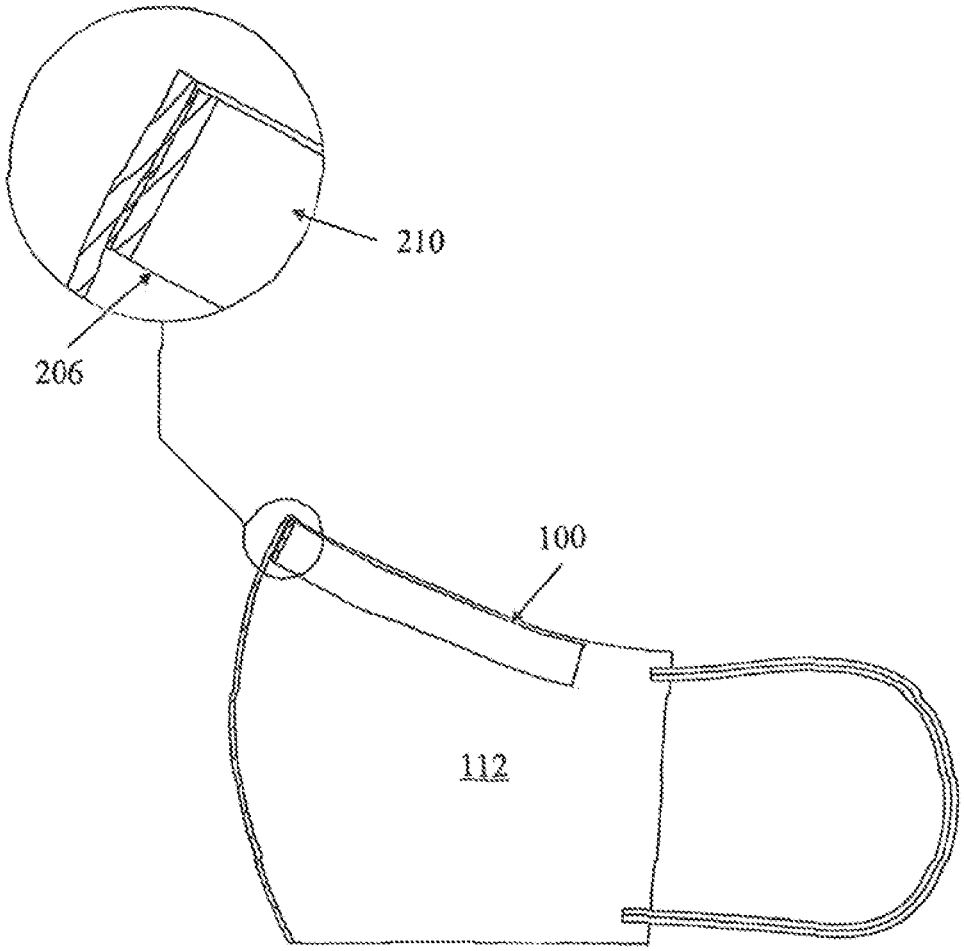
FIG. 9 is an elevational and partially zoomed in side view of one embodiment of an anti-fog strip for removable face masks and a cloth-based body, in accordance with the present invention.

As best seen in FIG. 1 and FIG. 3, the cloth-based body 102 may further include a left body edge 116 with the first ear loop 104 extending outwardly therefrom and interposing the upper and lower body edges 108, 110; a right body edge 118 with the second ear loop 106 extending outwardly therefrom and interposing the upper and lower body edges 108, 110; an upper edge length defined by the upper body edge 108 and separating the left and right body edges 116, 118, wherein the layup length 304 separating two opposing ends 300, 302 of the anti-fog strip layup 100 spans at least 75% of the upper edge length; and a lower edge length defined by the lower body edge 110 and separating the left and right body edges 116, 118. In preferred embodiments, the upper edge length and the lower edge length are approximately 6.5 inches in length, though the foregoing is merely an exemplary measurement that may vary depending on the shape, form, type, and size of face mask or facial covering being used.

An improvement has been disclosed that is used in combination with the cloth-based body 102 having the first ear loop 104 coupled thereto, the second ear loop 106 coupled thereto, the upper body edge 108, the lower body edge 110 opposing the upper body edge 108, the outer body surface 112, and the inner body surface 114 opposing the outer body surface 112, wherein the improvement comprises the anti-fog strip layup 100 disposed proximal to the upper body edge 108 and having the inner strip layer 200 of a flexible material, with the outer surface 202 adhesively coupled to the inner body surface 114, and with the inner surface 204 opposing the outer surface 202 of the inner strip layer 200; and the outer strip layer 206 of a flexible polymeric foam material, with the inner surface 208 adhesively coupled to the inner surface 204 of the inner strip layer 200, and with the outer surface 210 opposing the inner surface 204 of the inner strip layer 200, wherein the outer strip layer 206 is operably configured to elastically deform and contour to a user's nasal bridge.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. An anti-fog strip for removable face masks comprising:

a cloth-based body having a first ear loop coupled thereto, a second ear loop coupled thereto, an upper body edge, a lower body edge opposing the upper body edge, an outer body surface, an inner body surface opposing the outer body surface, and an anti-fog strip layup disposed proximal to the upper body edge and having:

a layup length separating two opposing ends of the anti-fog strip;

an inner strip layer of a flexible material, with an outer surface adhesively coupled to the inner body surface, and with an inner surface opposing the outer surface of the inner strip layer; and an outer strip layer of a flexible polymeric foam material, with an inner surface adhesively coupled to the inner surface of the inner strip layer, with an outer surface opposing the inner surface of the inner strip layer, with two opposing ends and an outer strip length separating the two opposing ends of the outer strip layer, with a first removable section defining one of the two opposing ends and selectively removably coupled to the inner strip layer and an unperforated single stationary section spanning at least 75% of the layup length, the first removable section and the unperforated single stationary section flanking a perforated channel and the first removable section operably configured to be removed and expose the inner surface of the inner strip layer with adhesive exposed thereon, and with a second removable section defining another of the two opposing ends and selectively removably coupled to the inner strip layer and the unperforated single stationary section, the second removable section and the unperforated single stationary section flanking a perforated channel and the second removable section operably configured to be removed and expose the inner surface of the inner strip layer with adhesive exposed thereon and wherein the outer strip layer is operably configured to elastically deform and contour to a user's nasal bridge.

2. The anti-fog strip according to claim 1, wherein the anti-fog strip layup further comprises:

a retaining wire member of a deformably rigid metallic material encapsulated and adhesively retained by the inner and outer strip layers.

3. The anti-fog strip according to claim 2, wherein the retaining wire member further comprises:

two opposing ends and a wire length separating the two opposing ends, the wire length sized to be at least 75% the layup length separating the two opposing ends of the anti-fog strip layup.

4. The anti-fog strip according to claim 2, wherein the retaining wire member further comprises:

two opposing ends and a wire length separating the two opposing ends, wherein each of the two opposing ends of the retaining wire member are respectively surrounded by rubber coverings.

5. The anti-fog strip according to claim 1, wherein the anti-fog strip layup further comprises:

a retaining wire member of a deformably rigid metallic material encapsulated, adhesively retained by the inner strip layer and the unperforated single stationary section, having two opposing ends, and having a wire length separating the two opposing ends.

6. The anti-fog strip according to claim 5, wherein the wire length of the retaining wire member does not extend to either the first removable section or the second removable section.

7. The anti-fog strip according to claim 1, wherein:

the flexible polymeric material of the outer strip layer is elastic and the flexible material of the inner strip layer is inelastic and polymeric.

8. The anti-fog strip according to claim 1, further comprising:

a lower strip layup disposed proximal to the lower body edge of the cloth-based body and having:

an inner strip layer of a flexible material, with an outer surface adhesively coupled to the inner body surface, and with an inner surface opposing the outer surface of the inner strip layer; and an outer strip layer of a flexible polymeric foam material, with an inner surface adhesively coupled to the inner surface of the inner strip layer, and with an outer surface opposing the inner surface of the inner strip layer, wherein the outer strip layer is operably configured to elastically deform and contour a user's nasal bridge.

9. The anti-fog strip according to claim 8, wherein the outer strip layer of the lower strip layup further comprises:

two opposing ends and an outer strip length separating the two opposing ends of the outer strip layer of the lower strip layup;

a first removable section defining one of the two opposing ends of the lower strip layup and selectively removably coupled to the inner strip layer of the lower strip layup and a single stationary section, the first removable section of the lower strip layup and the single stationary section of the lower strip layup flanking a perforated channel and the first removable section of the lower strip layup operably configured to be removed and expose the inner surface of the inner strip layer of the lower strip layup; and a second removable section defining another of the two opposing ends of the lower strip layup and selectively removably coupled to the inner strip layer of the lower strip layup and the single stationary section of the lower strip layup, the second removable section of the lower strip layup and the single stationary section of the lower strip layup flanking a perforated channel and the second removable section of the lower strip layup operably configured to be removed and expose the inner surface of the inner strip layer.

10. The anti-fog strip according to claim 1, wherein:

the flexible material of the inner strip layer of the anti-fog strip layup is inelastic and polymeric.

11. The anti-fog strip according to claim 1, wherein the cloth-based body further comprises:

a left body edge with the first ear loop extending outwardly therefrom and interposing the upper and lower body edges;

a right body edge with the second ear loop extending outwardly therefrom and interposing the upper and lower body edges;

an upper edge length defined by the upper body edge and separating the left and right body edges, wherein the layup length separating the two opposing ends of the anti-fog strip layup spans at least 75% of the upper edge length; and a lower edge length defined by the lower body edge and separating the left and right body edges.

12. The anti-fog strip according to claim 1, wherein the layup length separating the two opposing ends of the anti-fog strip layup is between 5 inches and 6 inches in length.

13. In combination with a cloth-based body having a first ear loop coupled thereto, a second ear loop coupled thereto, an upper body edge, a lower body edge opposing the upper body edge, an outer body surface, and an inner body surface opposing the outer body surface, wherein the improvement comprises:

an anti-fog strip layup disposed proximal to the upper body edge and having:

a layup length separating two opposing ends of the anti-fog strip;

an inner strip layer of a flexible material, with an outer surface adhesively coupled to the inner body surface, and with an inner surface opposing the outer surface of the inner strip layer; and an outer strip layer of a flexible polymeric foam material, with an inner surface adhesively coupled to the inner surface of the inner strip layer, with an outer surface opposing the inner surface of the inner strip layer, with two opposing ends and an outer strip length separating the two opposing ends of the outer strip layer, with a first removable section defining one of the two opposing ends and selectively removably coupled to the inner strip layer and an unperforated single stationary section spanning at least 75% of the layup length, the first removable section and the unperforated single stationary section flanking a perforated channel and the first removable section operably configured to be removed and expose the inner surface of the inner strip layer with adhesive exposed thereon, and with a second removable section defining another of the two opposing ends and selectively removably coupled to the inner strip layer and the unperforated single stationary section, the second removable section and the unperforated single stationary section flanking a perforated channel and the second removable section operably configured to be removed and expose the inner surface of the inner strip layer with adhesive exposed thereon, wherein the outer strip layer is operably configured to elastically deform and contour to a user's nasal bridge.

14. An anti-fog strip for removable face masks comprising:

a layup length separating two opposing ends of the anti-fog strip;

an inner strip layer of a flexible material and with an inner surface opposing the outer surface of the inner strip layer; and an outer strip layer of a flexible polymeric foam material, with an inner surface adhesively coupled to the inner surface of the inner strip layer, with an outer surface opposing the inner surface of the inner strip layer, with two opposing ends and an outer strip length separating the two opposing ends of the outer strip layer, with a first removable section defining one of the two opposing ends and selectively removably coupled to the inner strip layer and an unperforated single stationary section spanning at least 75% of the layup length, the first removable section and the unperforated single stationary section flanking a perforated channel and the first removable section operably configured to be removed and expose the inner surface of the inner strip layer with adhesive exposed thereon, and with a second removable section defining another of the two opposing ends and selectively removably coupled to the inner strip layer and the unperforated single stationary section, the second removable section and the unperforated single stationary section flanking a perforated channel and the second removable section operably configured to be removed and expose the inner surface of the inner strip layer with adhesive exposed thereon and wherein the outer strip layer is operably configured to elastically deform and contour to a user's nasal bridge.

* * * * *